US006300924B1

(12) United States Patent
Markandey et al.

(10) Patent No.: US 6,300,924 B1
(45) Date of Patent: Oct. 9, 2001

(54) DISPLAYING VIDEO DATA ON A SPATIAL LIGHT MODULATOR

(75) Inventors: Vishal Markandey, Dallas; Stephen W. Marshall, Richardson; Donald B. Doherty, Irving; Venkat V. Easwar; Paul M. Urbanus, both of Dallas; Robert J. Gove, Plano, all of TX (US)

(73) Assignee: Texas Instruments Incorporated, Dallas, TX (US)

( * ) Notice: Subject to any disclaimer, the term of this patent is extended or adjusted under 35 U.S.C. 154(b) by 1387 days.

(21) Appl. No.: 08/561,223

(22) Filed: Nov. 21, 1995

Related U.S. Application Data

(63) Continuation of application No. 08/177,043, filed on Jan. 3, 1994, now abandoned.

(51) Int. Cl.[7] ..... G09G 3/34
(52) U.S. Cl. ..... 345/84; 348/771
(58) Field of Search ..... 345/84, 85, 86, 345/87, 98, 100, 103; 348/771, 772, 750, 758

(56) References Cited

U.S. PATENT DOCUMENTS 4,481,511 * 11/1984 Hanmura et al. ..... 345/100
5,168,270 * 12/1992 Masumori et al. ..... 345/100
5,231,388 * 7/1993 Stoltz ..... 345/84

OTHER PUBLICATIONS

R. Deubert, "Feature IC's For Digivision TV Sets," reprinted from *IEEE Transactions on Consumer Electronics,* vol. CE–29, No. 3, Aug., 1983, pp. 237–241.

S. Naimpally, et al., "Integrated Digital IDTV Receiver with Features," *IEEE Transactions on Consumer Electronics,* vol. 34, No. 3, Aug., 1988, pp. 410–419.

* cited by examiner

*Primary Examiner*—Xiao Wu
(74) *Attorney, Agent, or Firm*—Charles A. Brill; Wade James Brady III; Frederick J. Telecky, Jr.

(57) ABSTRACT

An SLM-based video receiver (10) receives a video input of some standardized format at a signal interface unit (11) and passes the input to a processor (12). The processor (12) performs analog-to-digital conversion if the pixel data is analog and also performs other enhancements to prepare the pixel data for loading into a video memory (14). The pixel data from the processor (12), representing a field of pixel data, is stored into the memory (14) for loading into rows of pixel elements of a spatial light modulator (16). The spatial light modulator (16) receives the pixel data in rows and each individual pixel element responds accordingly. The pixel elements of the spatial light modulator (16) emit light or reflect light from a source (18) and generate a video frame for display on a screen (20). By exploiting the addressing functions of the spatial light modulator (16), the SLM-based video receiver (10) displays a video frame using a field of pixel data.

10 Claims, 3 Drawing Sheets

DISPLAYING VIDEO DATA ON A SPATIAL LIGHT MODULATOR

This application is a continuation of application Ser. No. 08/177,043 filed on Jan. 3, 1994, now abandoned.

TECHNICAL FIELD OF THE INVENTION

This invention relates to video display systems, and more particularly to a method and apparatus for displaying video data on a spatial light modulator.

BACKGROUND OF INVENTION

A recent development in video display systems is the use of spatial light modulators (SLMs) instead of raster-scan electronic beam devices. An SLM consists of an array of electronically addressable pixel elements. Each element either emits or reflects light to be projected on a display screen. For many applications, an SLM is binary in the sense that each pixel element may have either of two states. The element may be off and deliver no light or the element may be on and deliver light at a maximum intensity. Recent developments in SLM technology greatly impact the parallel development of high quality video display systems.

An SLM frequently used in display systems is the digital mirror device (DMD), in which each pixel element is a tiny mirror capable of individual mechanical movement in response to an electrical input. Each pixel element of a DMD reflects and modulates incident light in direction, phase, or amplitude. Recent advances in the fabrication and use of SLMs, and DMDs in particular, permit a high pixel density suitable for operation in high quality video display systems.

Standard television systems receive and display "interlaced" video data. This means that each frame of video data displayed on the standard system contains two or more fields. In a two field format, the first field may, for example, include the odd rows of the video frame. The second field may include the even rows of the same video frame. The interlaced fields making up the single frame are received and displayed successively on a standard raster-scan system and appear to a viewer as a single frame.

SLMs are capable of addressing all pixel elements of each video frame simultaneously, rather than scanning them. Various techniques for exploiting this capability to provide high quality images are being developed.

SUMMARY OF THE INVENTION

In accordance with the present invention, a method and apparatus for displaying video data on an SLM substantially eliminate or reduce the disadvantages and problems with prior SLM video display systems. The present invention contemplates a method and apparatus for displaying a complete video frame from a single field of video data without an appreciable increase in memory or processing by exploiting the addressing characteristics of the SLM.

In accordance with one aspect of the invention, a spatial light modulator includes an array of pixel elements arranged in display rows. Each display row receives a row of pixel data specifying the state of pixel elements. A row selector connects to each display row by an enable line and addresses two adjacent display rows so that both receive the same pixel data.

In accordance with another aspect of the present invention, a method is disclosed to use an SLM to display a video frame having a number of display rows that is a multiple of the number of rows of incoming pixel data per field. The spatial light modulator contains an array of pixel elements arranged in display rows. A row of pixel data is received into an input register of the spatial light modulator. The pixel elements in at least two adjacent display rows of the spatial light modulator change state in response to the row of pixel data in the input register.

It is a technical advantage of the present invention to provide a method and apparatus for displaying video data that exploit SLM addressability. Address circuitry that enables SLM pixel elements can efficiently display a video frame from a field of interlaced video data. Addressing signals cause two adjacent display rows on the SLM to be loaded, thereby transforming a field of interlaced video data into a video frame for display. For example, for standard two-field interlaced video data, the present invention addresses rows of pixel elements on the SLM at twice the speed of receiving and storing the video data.

It is another technical advantage of the present invention to provide a method and apparatus for displaying video data using an SLM that use less video data processing and storage than other display systems. By exploiting addressing functions residing on the SLM, the present invention stores a single field of video data in memory to display an entire video frame on the SLM. Furthermore, by performing addressing and data manipulation on the SLM, the present invention reduces the amount of front end processing of the video data and reduces the data bandwidth into the SLM.

BRIEF DESCRIPTION OF THE DRAWINGS

For a more complete understanding of the present invention, and the advantages thereof, reference is now made to the following descriptions taken in conjunction with the accompanying drawings.

DETAILED DESCRIPTION OF THE INVENTION

Figure 1:
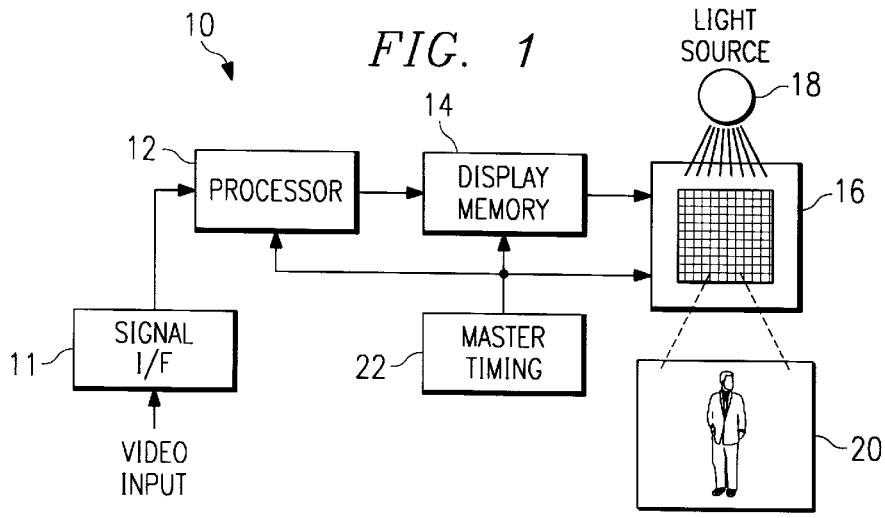
FIG. 1 is a block diagram of an SLM video display system constructed according to the teachings of the present invention.

FIG. 1 illustrates an SLM-based video receiver 10 constructed according to the teachings of the present invention. This receiver 10 is only one application of the invention, and other applications may be implemented using the same concepts described below. A specific example of receiver 10 of FIG. 1, and the example used throughout this description, is a television display system.

As an overview of the operation of receiver 10, signal interface unit 11 receives a video input of some standardized format containing pixel data and passes the input to processor 12. Processor 12 performs analog to digital conversion if the pixel data is analog and performs other processing tasks to prepare the pixel data for display. A field of pixel data is stored into memory 14 for writing into rows of pixel elements on SLM 16. SLM 16 receives the pixel data and the individual pixel elements respond accordingly. The pixel elements of SLM 16 emit light or reflect light from a source 18 and generate an image for display on screen 20.

For purposes of the example used throughout this description, the incoming video data is a National Television Standards Committee (NTSC) interlaced video signal, sampled for 400 rows and 640 columns of pixels. The video data may also be in other standard video formats, such as Phase Alternating Line (PAL), Sequential Color with Memory (SECAM), and Society of Motion Pictures Engineers (SMPTE), among others. Non-interlaced video input could also be used to display frames of data, where each display frame has a number of rows that is a multiple of the number of rows in each field of the incoming video data.

The video input to receiver 10 may come from a variety of sources, including land-based transmissions received over an antenna, coaxial cable transmissions, digital fiber optic line transmissions, and satellite transmissions, among others. The video input may also be digital, obviating the need for an analog to digital conversion in processor 12. Therefore, the video display system of FIG. 1 contemplates receiving monochrome or color video data, either analog or digital, and from a variety of transmission media.

After signal interface 11 receives a video input, processor 12 prepares pixel data for display by performing tasks such as color separation, color space conversion, and de-gama correction. Further details about an exemplary processor 12 for use with SLM 16, are set out in U.S. Pat. No. 5,079,544, entitled "Standard Independent Digitized Video System"; U.S. patent Ser. No. 08/147,249, entitled "Digital Television System"; U.S. patent Ser. No. 07/678,761, entitled "DMD Architecture and Timing for Use in a Pulse-Width Modulated Display System"; U.S. patent Ser. No. 07/809,816, entitled "White Light Enhanced Color Field Sequential Projection"; and U.S. patent Ser. No. 08/146,385, entitled "DMD Display System". Each of these patents and patent applications are assigned to Texas Instruments Incorporated, and each is herein incorporated by reference.

Memory 14 has a capacity of one field of pixel data, representing a subset of each video frame to be displayed on SLM 16. As explained below, memory 14 provides pixel data to all pixel elements of SLM 16, using a stored single field of pixel data.

Although the present invention contemplates any memory device to store the pixel data, one particular example is a video random access memory (VRAM). A VRAM includes an internal parallel in/serial out shift register that can be accessed independently from the rest of the memory unit. In one memory cycle, the VRAM transfers an entire row of pixel data from memory to the shift register for delivery to SLM 16. The VRAM memory continues to accept input data during read out from the shift register. Such a VRAM allows higher throughput of data in the SLM-based video receiver. An example of a suitable VRAM is the TMS4161 integrated circuit, manufactured by Texas Instruments Incorporated.

SLM 16 is an array of electronically addressable pixel elements, and more particularly for purposes of this description, a digital mirror device (DMD). An example of SLM 16 is the DMD manufactured by Texas Instruments Incorporated in which each pixel element has a pixel mirror connected to a memory element that stores at least one bit of data. Such a device receives the desired state of each pixel element into its corresponding memory element. Upon loading all memory elements, SLM 16 switches all pixel elements simultaneously. A memory element of a DMD may be shared by a number of pixel mirrors or dedicated to a single pixel mirror. A pixel element is the combination of a pixel mirror and an associated memory element, whether shared or dedicated.

The present invention applies not only to DMDs, but also to other binary SLMs having addressable pixel elements. A suitable SLM 16 receives pixel data corresponding to rows of pixel elements. Because the data stored in rows of SLM 16 are not necessarily coincident with rows of data in memory 14, the former data are referred to as "display rows" and the latter data as "memory rows," "rows of video data," or "rows of pixel data."

SLM-based video receiver 10 may display intermediate levels of light using a variable intensity technique, such as pulse-width modulation. Pulse-width modulation uses various schemes for loading SLM 16, including "bit-plane" loading, in which one bit per pixel for an entire frame is loaded at one time. For pixel data having an 8-bit value per pixel, SLM 16 is loaded eight times per display cycle, with the load timing governed by the particular modulation scheme. Therefore, a pixel element may switch states multiple times in a single display cycle.

U.S. patent Ser. No. 07/678,761, referenced above, describes a method of pulse-width modulation where SLM 16 loads the most significant bit for one half of a display cycle, the second most significant bit for one fourth of a display cycle, and so on. The loading occurs in bit-plane bursts, during a "least significant bit time," which is calculated by dividing the display cycle into $2^N-1$, where N is the resolution of each pixel. For example, for eight bit pixel resolution and sixty display cycles each second, the least significant bit time is 65.36 microseconds. SLM 16 may operate at sixty display cycles each second, which is the field transmission rate of standardized NTSC interlaced data, since the addressing techniques of the present invention allow SLM 16 to display a complete frame for each field of video data received.

SLM 16 may conduct bit-frame loading by frame, by display row, or by reset group in a split reset DMD, discussed below. Furthermore, any number of bits may be used to achieve the desired intensity level resolution. Therefore, it is understood that the SLM-based video receiver 10 of FIG. 1 contemplates use of pulse-width modulation or other appropriate technique to vary the intensity of light emitted or reflected by the individual SLM pixel elements.

To display a black and white image, receiver 10 requires a single channel of pixel data. To display a color image, receiver 10 requires several channels or several pixel data components in color space. For example, a first component represents a red video signal, a second component a green video signal, and a third component a blue video signal. It is understood that the number and color of the pixel data components in color space may vary without departing from the teachings of the present invention. SLM 16 can display these pixel data components representing a color image in a sequential or nonsequential manner.

A nonsequential color system uses a pixel element array for each pixel data component. Light source 18 in a nonsequential system comprises, for example, separate blue, green, and red light sources to be reflected against three pixel element arrays. This particular embodiment of a non-sequential color display system requires three times the pixel elements of a sequential display system.

In contrast, a sequential color system requires only one pixel element array that sequentially receives each pixel data component. The light source 18 in a sequential system may be, for example, a color wheel that sequentially illuminates the pixel element array with red, blue, and green light. One example of sequential color imaging is described in pending U.S. patent Ser. No. 08/179,028, entitled "Method and Apparatus for Sequential Color Imaging," herein incorporated by reference.

The SLM-based video receiver 10 of FIG. 1, therefore, contemplates displaying a monochrome image, or a color image using any appropriate sequential or nonsequential methodology. Light source 18, shown as a separate element from SLM 16 in FIG. 1, is required if the individual pixel elements include adjustable mirrored surfaces that reflect light. However, if the individual pixel elements of SLM 16 are capable of generating light, like light emitting diodes (LEDs), light source 18 is not required.

Display 20 receives the reflected or emitted light from SLM 16 and projects this light against a screen for display. Display 20 can be a back-lit system, such as a television, where the viewer is on an opposite side of the screen from the reflected or emitted light from SLM 16. Display 20 can also be a projection system where the reflected or emitted light is located on the same side of the screen as the viewer. Master timing circuitry 22 coordinates the timing between processor 12, memory 14, and SLM 16.

FIG. 1 shows SLM 16 containing an array of pixel elements as a separate component of receiver 10. It is understood, however, that any combination of signal interface 11, processor 12, memory 14, SLM 16, light source 18, display 20, master timing circuitry 22, and any other related circuitry can be integral to receiver 10 or separate components of an overall video display system. For example, SLM 16, memory 14, part of master timing circuitry 22, and other addressing functions may reside on a single fabricated chip or device. The present invention contemplates any such combination of elements in FIG. 1.

Figure 2A:
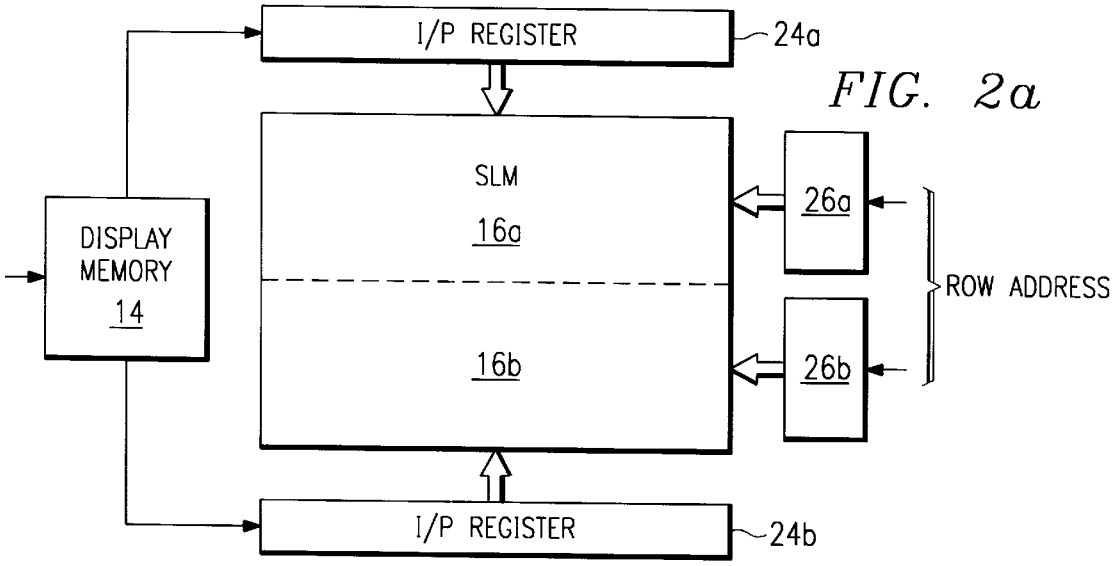
FIG. 2*a* is a block diagram of an SLM constructed according to the teachings of the present invention.

FIG. 2*a* illustrates SLM 16 in further detail. In this particular embodiment, SLM 16 is partitioned, such that it receives data simultaneously into upper pixel array 16*a* and lower pixel array 16*b*, via upper input register 24*a* and lower input register 24*b*, respectively. It is understood that this invention applies to partitioned or nonpartitioned SLMs. Pixel arrays 16*a* and 16*b* comprise rows of pixel mirrors connected to a shared or dedicated memory element to store the state of the mirror. A pixel element, comprising a pixel mirror and its associated memory element, is "loaded" by storing a desired state in its corresponding memory element, such as "0" or "1" if the pixel element operates as a binary device. The pixel element is then "reset" by altering the state of the pixel element to correspond to the desired state stored in its memory element.

Loading video data from memory 14 to either upper or lower pixel arrays of SLM 16 is identical. Therefore, now referring to upper pixel array 16*a* of SLM, memory 14 outputs a row of pixel data to register 24*a*. Row selector or row decoder 26*a* receives a display row address and enables two or more display rows on upper pixel array 16*a* to receive pixel data from register 24*a*. Upper pixel array 16*a* receives into each memory element the desired state data for its corresponding pixel element on SLM 16. Upon loading of all display rows of SLM 16 from registers 24*a* and 24*b*, SLM 16 receives a common reset signal to change each pixel element to its desired state stored in its corresponding memory element. Memory 14, registers 24*a* and 24*b*, and row selectors 26*a* and 26*b* may be separate elements or integral to SLM 16.

The number of rows of pixel data stored in memory 14 is a subset of the number of display rows of SLM 16. However, by exploiting the addressability of SLM 16, the rows of pixel data fill all of the display rows, effectively displaying a complete frame from a field of pixel data. If the display system performs pulse-width modulation to vary the intensity of each pixel during a display cycle, memory 14 will store, for example, eight bits of data for each pixel. Therefore, a display cycle, occurring sixty times a second, includes $2^8-1$, or 255, separate time slices of 65.36 microseconds where individual SLM pixel elements can change state.

In one embodiment of the present invention, registers 24*a* and 24*b* receive a row of pixel data with the number of bits equal to the number of columns of pixel elements of SLM 16. Registers 24*a* and 24*b* may contain parallel latches that increase throughput by storing a first row of pixel data while the register receives a second row of pixel data from memory 14. Registers 24*a* and 24*b* may also contain column drivers that drive each bit in a row of pixel data to each column of pixel arrays 16*a* and 16*b*. In our example, registers 24*a* and 24*b*, and any additional latches or drivers, process a 640 bit row of pixel data corresponding to the 640 columns of SLM 16.

Row selectors or row decoders 26*a* and 26*b* receive a display row address to enable two or more display rows in pixel arrays 16*a* and 16*b*. The display row address received by row selectors 26*a* and 26*b* may be generated in memory 14, or alternatively in master timing circuitry 22, processor 12, or by other appropriate SLM circuitry. In one embodiment, row selectors 26*a* and 26*b* are decoders that each receive a display row address which represents one of 240 display rows to be filled in the upper or lower pixel arrays 16*a* and 16*b*. Row selectors 26*a* and 26*b* decode the display row address and assert one or more enable lines to enable the selected display rows. Row selectors 26*a* and 26*b* may mask the least significant bit of a display row address, thereby simultaneously enabling two adjacent rows. Furthermore, row selectors 26*a* and 26*b* may sequentially or simultaneously assert two display row enable lines in response to receiving one or more display row addresses.

During operation of SLM 16 pictured in FIG. 2*a*, memory 14 stores a single interlaced field of video data and, therefore, stores enough rows of pixel data to load into a subset of the display rows of SLM 16. For standard interlaced data comprising two fields, memory 14 stores in succession rows of pixel data corresponding to the odd and even rows of SLM 16. For example, for display cycle one, memory 14 stores rows of pixel data for odd display rows, and for display cycle two, memory 14 stores rows of pixel data for even display rows. To display a complete video frame, in other words to load all display rows of SLM 16 with pixel data, a single row of pixel data in memory 14 loads into two display rows in SLM 16. This is accomplished through addressing techniques without an appreciable increase in memory or processing.

One technique to load more than one display row with a single row of pixel data is to maintain the row of pixel data in register 24*a* while inputting more than one separate display row address to row selector 26*a* in succession. For example, register 24*a* stores a row of pixel data and a first display row address causes row selector 26*a* to enable display row twelve of pixel array 16*a* and load the data. Before the row of pixel in register 24*a* is replaced with a new row of pixel data from memory 14, a second display row address input to row selector 26*a* causes display row thirteen to be enabled and stored with the same contents in register 24*a*. By addressing more than one display row to receive a single row of pixel data stored in register 24*a*, a complete video frame can be displayed on SLM 16 from a field of pixel data stored in memory 14.

Figure 2B:
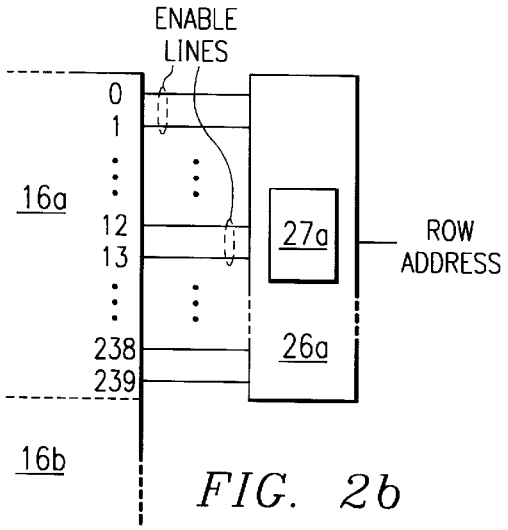
FIG. 2*b* is a detailed view of an SLM row selector constructed according to the teachings of the present invention.

FIG. 2*b* illustrates in detail another technique to load more than one display row with a single row of pixel data. In this embodiment, the least significant bit or bits of the display row address input to row selector 26*a* are ignored, adjusted, or masked. For example, assume row selector 26*a* enables row twelve in response to a four bit display row address "1100". If the least significant bit of the display row address is ignored then the display row address may be represented as "110X", where X can be either a "0" or a "1". In response, row selector 26*a* with masking logic 27*a* simultaneously enables row twelve (display row address "1100") and row thirteen (display row address "1101"). Alternatively, row selector 26*a* with masking logic 27*a* may assert enable lines for display rows twelve and thirteen in succession. Therefore, the row of pixel data stored in register 24*a* loads into display rows twelve and thirteen, either simultaneously or sequentially, in response to a single display row address by ignoring the least significant bit.

In addition, masking logic 27*a* may accomplish the "masking" function by adding or subtracting to or from the received display row address to generate additional display row addresses. For example, row selector 26*a* with masking logic 27*a* may receive a display row address "1100" and generate a second display row address "1101" by adding one. The present invention contemplates any operation of row selector 26*a* with masking logic 27*a* that asserts two or more display row enable lines in response to a single display row address.

Figure 2C:
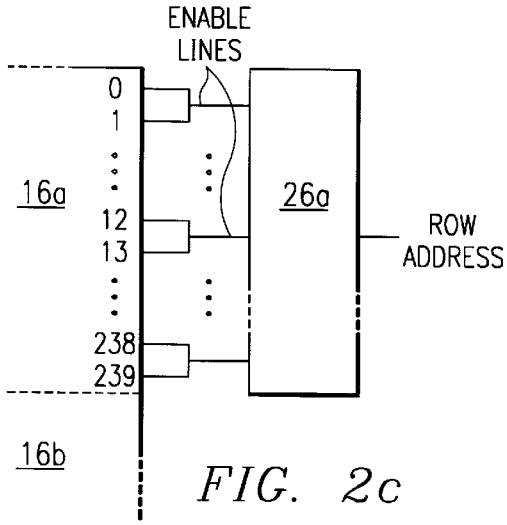
FIG. 2*c* is a detailed view of an alternative embodiment of the SLM row selector constructed according to the teachings of the present invention.

FIG. 2*c* illustrates in detail yet another technique to load more than one display row with a single row of pixel data. Since pairs of display row enable lines are tied together, row selector 26*a* can assert a common enable line to load a pair of adjacent display rows. As a result, the least significant bit of the display row address is masked. For example, row selector 26*a* of FIG. 2*c* can assert 120 separate enable lines, each enable line tied to two display rows of upper pixel array 16*a*. Therefore, in this particular example, a row address seven bits wide can enable all display rows of upper pixel array 16*a*. From the example above, assume row selector 26*a* receives a three bit display row address "110" as a result of masking the least significant bit. In response, row selector 26*a* asserts the common enable line tied to display rows twelve and thirteen. Therefore, the row of pixel data stored in register 24*a* simultaneously loads into display rows twelve and thirteen by asserting a common enable line in response to a single display row address with the least significant bit masked.

Figure 3A:
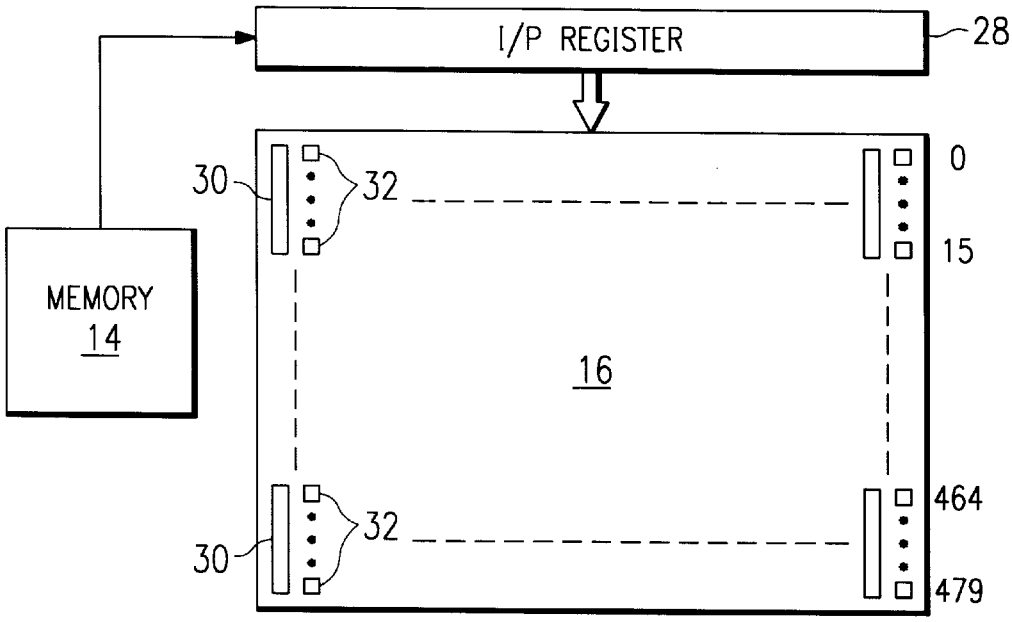
FIG. 3*a* is a block diagram of an alternative SLM constructed according to the teachings of the present invention.
Figure 3B:
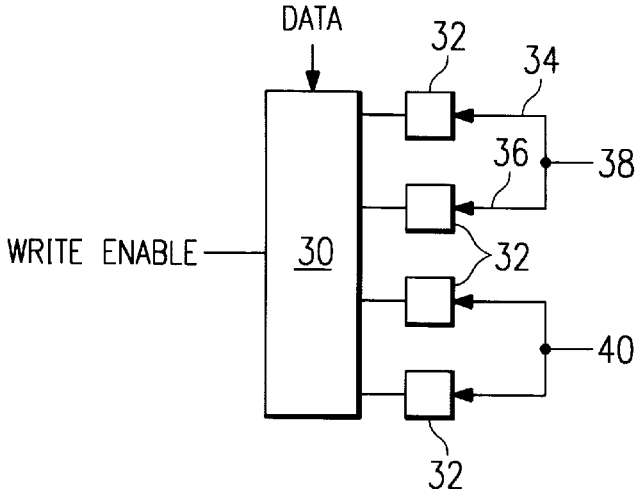
FIG. 3*b* is a detailed view of an alternative SLM constructed according to the teachings of the present invention.

FIGS. 3*a* and 3*b* illustrate a split reset SLM that can also be used with the present invention. Referring now to FIG. 3*a*, memory 14 outputs pixel data to register 28 to load memory elements 30 within SLM 16. A single memory element 30 spans several rows of pixel mirrors 32 and delivers a data signal to all pixel mirrors to which it is connected. A pixel element comprises a pixel mirror and its associated, shared memory element. The first pixel element row associated with the first memory element row is numbered "0" and the last pixel element row associated with the last memory element row is numbered "479". The input or output connections of SLM 16, not shown in FIG. 3*a*, are described in more detail with reference to FIG. 3*b*. U.S. patent application Ser. No. 08/002,627, entitled "Pixel Circuitry for Spatial Light Modulator," filed on Jan. 8, 1993, and assigned to Texas Instruments Incorporated, discloses a split reset DMD image system and is herein incorporated by reference.

In operation, a split reset SLM divides SLM array 16 into a number of reset groups. For example, an array may be divided into sixteen reset groups of 19,200 pixel elements each. Memory element 30 provides data to all associated pixel mirrors 32, but only one pixel mirror 32 is reset at a time. A split reset SLM reduces the number of memory elements required on SLM 16 by a factor equal to the number of separate reset groups.

In our example of an SLM-based video receiver with 480 rows by 640 columns, the sixteen reset group SLM 16 shown in FIG. 3*a* contains thirty rows of memory elements and 640 memory elements per row, resulting in 19,200 total memory elements to be loaded by register 28. Accordingly, a 640 bit register receives a row of pixel data and loads in succession thirty memory element rows to fill all memory elements 30 in SLM 16. This is accomplished using a row selector, not shown, to enable in succession each memory element row to be loaded with the contents of register 28. After loading all memory elements 30, asserting a single reset line causes one pixel mirror 32 for each memory element 30 to be reset.

FIG. 3*b* illustrates in detail memory element 30 with four associated pixel mirrors 32. In one embodiment, memory element 30 stores a bit of pixel data upon receipt of a write enable signal. The stored pixel data is made available to all pixel mirrors 32, but a pixel mirror responds to the stored pixel data only upon receipt of a reset signal. For example, the first pixel mirror in FIG. 3*b* switches in response to the pixel data stored in memory element 30 upon receipt of a reset signal on reset line 34. Similarly, the second pixel mirror switches upon receipt of a reset signal on reset line 36.

Therefore, by tying reset lines 34 and 36 to a common reset line 38, both the first and second pixel mirrors switch in response to the pixel data stored in memory element 30. In a similar manner, reset line 40 resets the third and fourth pixel mirrors of each memory cell 30.

A single field of pixel data to be delivered to a subset of the display rows on SLX 16 can provide data for every pixel element if a reset signal is delivered to more than one reset group at a time. In this manner, memory 14 stores a single field of interlaced pixel data for all pixel elements on SLM 16. Therefore, by exploiting the addressability of a split reset SLM, and in particular by tying reset lines together, the SLM shown in FIGS. 3*a* and 3*b* can display a field of video data without an appreciable increase in video data storage or processing.

Figure 4A:
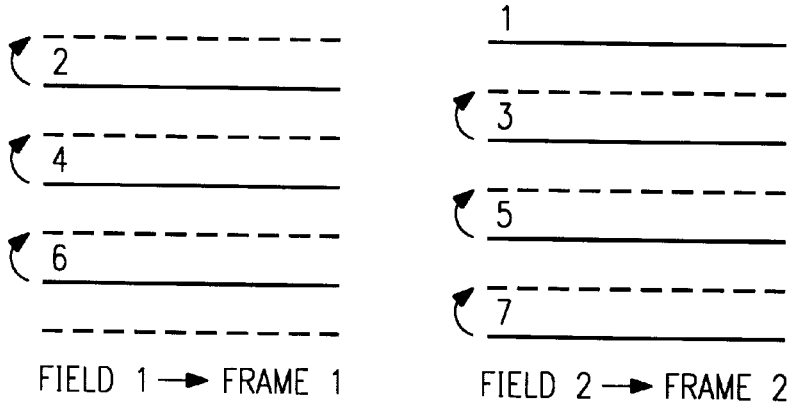
FIG. 4*a* illustrates an Up-Up display technique used in accordance with the teachings of the present invention.
Figure 4B:
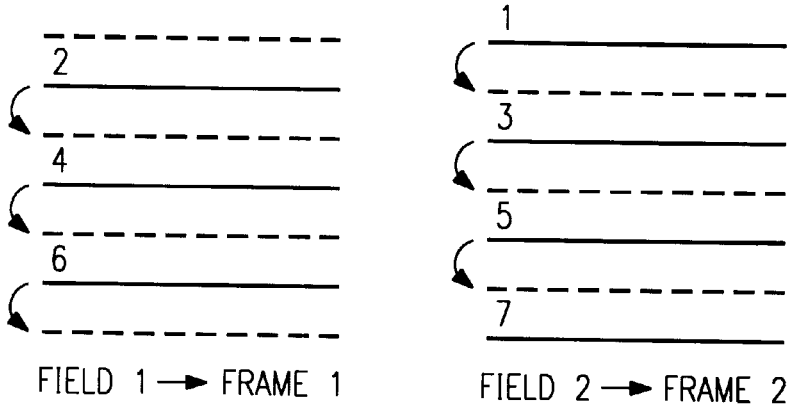
FIG. 4*b* illustrates a Down-Down display technique used in accordance with the teachings of the present invention.
Figure 4C:
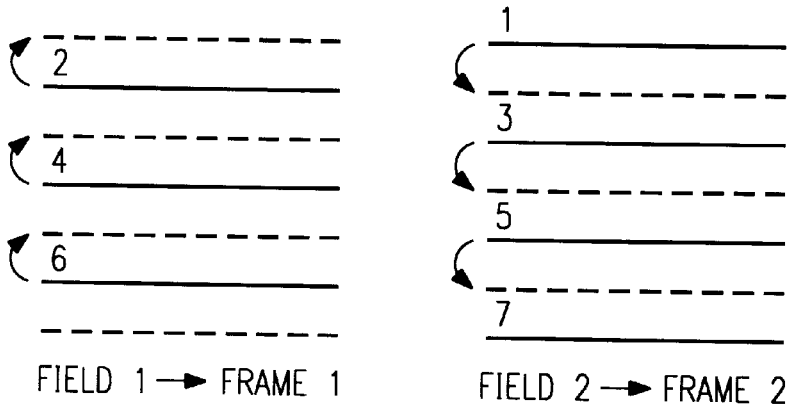
FIG. 4*c* illustrates an Up-Down display technique used in accordance with the teachings of the present invention.

FIGS. 4*a*–4*c* show three different techniques for displaying interlaced data using the SLM addressing functions described in FIGS. 2*a*–2*c* and 3*a*–3*b*. In all three display techniques, field 1 contains pixel data for even display rows and field 2 contains pixel data for odd display rows. However, the teachings of the present invention contemplate other interlaced formats with three or more fields of pixel data. For purposes of describing the display techniques shown in FIGS. 4*a*–4*c*, rows of incoming field data are represented by solid lines, while rows of data generated in accordance with the invention are represented by dashed lines.

The first display technique shown in FIG. 4*a,* designated Up-Up, pairs each display row with a display row directly above to receive the same row of pixel data. For field 1, display rows 1 and 2 receive the same pixel data. Similarly, display rows 3 and 4 receive the same pixel data. Likewise, for field 2, the odd display rows pair with the even display rows immediately above.

The second display technique shown in FIG. 4*b,* designated Down-Down, pairs each display row with a display row below. For example, in field 1, display rows 2 and 3 receive the same pixel data. Similarly in field 2, the odd display rows pair with the even display rows immediately below.

The third display technique shown in FIG. 4*c,* designated as Up-Down, pairs a display row with a display row adjacent and above for field 1 and then pairs a display row with a display row adjacent and below for field 2. Therefore, in field 1, display rows 1 and 2 receive the same pixel data, representing an upshift of pixel data. In field 2, display rows 1 and 2 receive the same pixel data, representing a downshift of pixel data.

To display interlaced pixel data containing two fields using the Up-Down display technique, the same two display rows receive the same pixel data for every frame. In effect, display rows 1 and 2 are tied together so that pixel data received for display row 1 also is used for display row 2, and pixel data received for display row 2 also is used for display row 1.

In FIG. 2*b,* as described above, row selector 26*a* with masking logic 27*a* may ignore or mask the least significant bit of the display row address and enable the same pair of display rows for each field of pixel data received, thereby performing the Up-Down display technique. The Up-Up or Down-Down techniques can also be achieved by adjusting the display row address to provide the next higher or lower address, respectively. FIG. 2*c* accomplishes the Up-Down technique by physically tying pairs of adjacent display rows to a common enable line. Similarly, in FIG. 3*b,* tying reset lines 34 and 36 together achieves the same Up-Down effect between fields.

There have been described certain embodiments of the invention that are capable of displaying a video frame from a field of pixel data without an a appreciable increase in pixel data processing and storage. While these embodiments have been described and disclosed, other changes, substitutions, or alterations can be made without departing from the spirit and scope of the invention, as described in the appended claims.

What is claimed is:

1. A spartial light modulator for displaying pixel data comprising:

a register for receiving rows of pixel data, wherein said rows of pixel data have all been processed by a common analog-to-digital converter;

an array of pixel elements arranged in display rows, said display rows connected to said register and operable to receive rows of pixel data from said register specifying states of pixel elements; and a row selector connected to said display rows by enable lines and operable to enable at least two adjacent display rows to receive a row of pixel data from said register, wherein said two adjacent display rows receive said row of pixel data simultaneously, wherein said row selector simultaneously enables two adjacent display rows via a common connection to their enable lines.

2. The spatial light modulator of claim 1, wherein said row selector simultaneously enables two adjacent display rows via a common connection to their enable lines by masking the least significant bit of display row address.

3. A spatial light modulator for displaying pixel data comprising:

a register for receiving rows of pixel data, wherein said rows of pixel data have all been processed by a common analog-to-digital converter;

an array of pixel elements arranged in display rows, said display rows connected to said register and operable to receive rows of pixel data from said register specifying states of pixel elements; and a row selector connected to said display rows by enable lines and operable to enable at least two adjacent display rows to receive a row of pixel data from said register, wherein said two adjacent display rows receive said row of pixel data simultaneously, wherein said row selector asserts enable lines for two adjacent display rows in response to receiving a display row address by adjusting a received display row address to generate a second display row address that enables an adjacent display row.

4. A spatial light modulator for displaying pixel data, comprising:

a register for receiving rows of pixel data, wherein said rows of pixel data have all been processed by a common analog-to-digital converter;

an array of pixel elements arranged in display rows, said display rows connected to said register and operable to receive rows of pixel data from said register specifying states of pixel elements; and a row selector connected to said display rows by enable lines and operable to enable at least two adjacent display rows to receive a row of pixel data from said register, wherein said two adjacent display rows receive said row of pixel data simultaneously, wherein said row selector asserts enable lines for two adjacent display rows in response to receiving a display row address by ignoring the least significant bit of said display row address.

5. A method of using a spatial light modulator to display a video frame comprised of pixel data of a field of incoming video signal, said spatial light modulator comprising an array of pixel elements arranged in display rows, comprising the steps of:

processing all of said pixel data in a common analog-to-digital converter;

receiving a row of pixel data into an input register of said spatial light modulator; and changing the state of pixel elements in two adjacent display rows in response to said row of pixel data in said input register, wherein said two adjacent display rows receive said row of pixel data simultaneously, said step of changing the state of pixel elements comprising writing pixel data to a shared memory element associated with a set of pixel elements comprising one pixel element from each of a succession of display rows, and delivering a reset signal to at least two pixel elements in said set of pixel elements.

6. A method of using a spatial light modulator to display a video frame comprised of pixel data of a field of an incoming video signal, said spatial light modulator comprising an array of pixel elements arranged in display rows, comprising the steps of:

processing all of said pixel data in a common analog-to-digital converter;

receiving a row of pixel data into an input register of said spatial light modulator;

addressing first and second display rows of said spatial light modulator to be loaded with said row of pixel data, wherein said first and second display rows are adjacent display rows, wherein said first and second display rows receive said row of pixel data simultaneously, the step of addressing comprising pairing said first and second display rows together via a common enable line;

loading said row of pixel data into said first and second display rows;

repeating said receiving, addressing, and loading steps for each row of pixel data in said field such that all display rows in said spatial light modulator receive pixel data; and displaying said video frame on said spatial light modulator by switching all display rows in accordance with loaded pixel date.

7. A method of using a spatial light modulator to display a video frame comprised of pixel data of a field of an incoming video signal, said spatial light modulator comprising an array of pixel elements arranged in display rows, comprising the steps of:

processing all of said pixel data in a common analog-to-digital converter;

receiving a row of pixel data into an input register of said spatial light modulator;

addressing first and second display rows of said spatial light modulator to be loaded with said row of pixel data, wherein said first and second display rows are adjacent display rows, wherein said first and second display rows receive said row of pixel data simultaneously, the step of addressing comprising receiving in succession two display row addresses specifying said first and second display rows and asserting in successsion enable lines connected to said first and second display rows;

loading said row of pixel data into said first and second display rows;

repeating said receiving, addressing, and loading steps for each row of pixel data in said field such that all display rows in said spatial light modulator receive pixel data; and displaying said video frame on said spatial light modulator by switching all display rows in accordance with loaded pixel date.

8. A method of using a spatial light modulator to display a video frame comprised of pixel data of a field of an incoming video signal, said spatial light modulator comprising an array of pixel elements arranged in display rows, comprising the steps of:

processing all of said pixel data in a common analog-to-digital converter;

receiving a row of pixel data into an input register of said spatial light modulator;

addressing first and second display rows of said spatial light modulator to be loaded with said row of pixel data, wherein said first and second display rows are adjacent display rows, wherein said first and second display rows receive said row of pixel data simultaneously, the step of addressing comprising receiving a single display row address with the least significant bit masked and asserting a common enable line connected to said first and second display rows;

loading said row of pixel data into said first and second display rows;

repeating said receiving, addressing, and loading steps for each row of pixel data in said field such that all display rows in said spatial light modulator receive pixel data; and displaying said video frame on said spatial light modulator by switching all display rows in accordance with loaded pixel date.

9. A method of using a spatial light modulator to display a video frame comprised of pixel data of a field of an incoming video signal, said spatial light modulator comprising a array of pixel elements arranged in display rows, comprising the steps of:

processing all of said pixel data in a common analog-to-digital converter;

receiving a row of pixel data into an input register of said spatial light modulator;

addressing first and second display rows of said spatial light modulator to be loaded with said row of pixel data, wherein said first and second display rows are adjacent display rows, wherein said first and second display rows receive said row of pixel data simultaneously;

loading said row of pixel data into said first and second display rows by writing pixel data to a shared memory element associated with a set of pixel elements comprising one pixel element from each of a succession of display rows, and delivering a reset signal to at least two pixel elements in said set of pixel elements;

repeating said receiving, addressing, and loading steps for each row of pixel data in said field such that all display rows in said spatial light modulator receive pixel data; and displaying said video frame on said spatial light modulator by switching all display rows in accordance with loaded pixel date.

10. A video display system to display a video frame comprised of pixel data of a field of an incoming video signal, comprising:

a processor to prepare said field of pixel data for storage, wherein said processor is also operable to convert all said data from analog to digital;

a memory to store a prepared field of pixel data in rows;

a register connected to said memory to receive rows of pixel data;

an array of pixel elements arranged in display rows, said display rows connected to said register and operable to receive rows of pixel data from said register specifying states of pixel elements;

a row selector connected to said display rows by enable lines and operable to address two adjacent display rows to receive a row of pixel data from said register, wherein said two adjacent display rows receive said row of pixel data simultaneously, wherein said row selector simultaneously enables two adjacent display rows via a common connection to their enable lines;

switching circuitry to switch pixel elements in response to received pixel data; and a light source reflecting off switched pixel elements to project said video frame on a screen for display.

* * * * *